US007032424B2

(12) United States Patent
Schunn et al.

(10) Patent No.: US 7,032,424 B2
(45) Date of Patent: Apr. 25, 2006

(54) CLUSTER MILL, IN PARTICULAR, A SIX-HIGH CLUSTER MILL, COMPRISING AN AXIAL DISPLACEMENT AND HOLDING DEVICE FOR DISPLACEABLY MOUNTED INTERMEDIATES ROLLS AND OR WORKING ROLLS

(75) Inventors: Konrad Walter Schunn, Korschenbroich (DE); Christa Kluge, Grevenbroich (DE)

(73) Assignee: SMS Demag AG, Dusseldorf (DE)

( * ) Notice: Subject to any disclaimer, the term of this patent is extended or adjusted under 35 U.S.C. 154(b) by 0 days.

(21) Appl. No.: 10/501,681

(22) PCT Filed: Dec. 5, 2002

(86) PCT No.: PCT/EP02/13765

§ 371 (c)(1),
(2), (4) Date: Dec. 15, 2004

(87) PCT Pub. No.: WO03/059545

PCT Pub. Date: Jul. 24, 2003

(65) Prior Publication Data

US 2005/0081593 A1 Apr. 21, 2005

(30) Foreign Application Priority Data

Jan. 18, 2002 (DE) ..... 102 02 217

(51) Int. Cl.
*B21B 31/18* (2006.01)

(52) U.S. Cl. ..... 72/247

(58) Field of Classification Search ..... 72/237, 72/247

See application file for complete search history.

(56) References Cited

U.S. PATENT DOCUMENTS 2,175,783 A 10/1939 Rose
4,785,651 A 11/1988 Kuhn

FOREIGN PATENT DOCUMENTS

EP 0026903 4/1981
JP 0152963 9/1975

*Primary Examiner*—Lowell A. Larson
(74) *Attorney, Agent, or Firm*—Abelman, Frayne & Schwab

(57) ABSTRACT

A cluster mill includes an axially displacing and holding device for displaceable intermediate and/or working mills (11), with the chocks (7) being guided in a sliding manner inside the cluster mill stand housing posts (1), the rolls (11) are be displaced in axially opposite directions by piston-cylinder units (5), and the piston rods (5*a*) are pivotally connected to a main traverse (4). In order to prevent the main traverse (4) from becoming damaged by non-uniform action of the piston-cylinder units (5) during displacement, there are provided moving beams (1*a*), which are located on both sides of the chock (7) and are mounted inside the cluster mill stand housing posts (1) via the connecting traverses (2), the connecting traverses (2) being pivotally connected to the middle of the main traverse (4), whereby the piston rods (5*a*) of the piston-cylinder units (5) are pivotally connected to opposite ends (4*a*, 4*b*) of the main traverse (4), and each piston-cylinder unit (5) is controlled according to path by a displacement sensor (10).

7 Claims, 2 Drawing Sheets

CLUSTER MILL, IN PARTICULAR, A SIX-HIGH CLUSTER MILL, COMPRISING AN AXIAL DISPLACEMENT AND HOLDING DEVICE FOR DISPLACEABLY MOUNTED INTERMEDIATES ROLLS AND OR WORKING ROLLS

The invention relates to a cluster mill, in particular a six-high cluster mill with an axially displacing and holding device for displaceably supported intermediate rolls and/or working rolls, wherein chocks are slidably displaced in rolling mill stands in a direction of a roll separating force, and wherein the intermediate rolls and/or working rolls, together with their respective chocks, are displaceable in axially opposite directions by hydraulic piston-cylinder units acting in a direction of roll axes, with both piston rods being pivotally connected by a respective main traverse.

On each side of a connecting traverse, there is provided a pivotally supportedly or fixedly screwed with the rolling mill stand, piston-cylinder unit for displacing an intermediate or working roll. Each piston-cylinder unit is controlled by its own servo-controlled circuit. The displacement path of the piston-cylinder units is determined by displacement sensors. A malfunction of the displacement sensor, hydraulic valves, or a defective contact of a control cable can cause displacement of the piston of the displacement cylinder in an uncontrolled manner to different heights or in an opposite direction. This can lead to damage of the connecting traverse and make it unusable.

The above-described cluster mill with an axially displaceable and holding device for intermediate rolls is provided, e.g., in form of two, projecting axially outwardly arms formed as pincers (DE 24 40 495 C3). To each of the arms, a telescopically extendable piston rod of a piston cylinder unit is connected with a connection member, with two piston-cylinder units being arranged in the rolling mill stand housing posts on opposite sides of and adjacent to respective chocks. Such constructions do not have a main traverse. However, they are not protected against an occurrence of a hydraulic or electrical malfunction.

A similar construction (DE 35 04 415 A1) includes a bearing for a roll, which is displaceable in the chock, and a displacement carriage in which a connection or coupling means for the journal are located. Here also, the operation of the piston-cylinder units, which extend parallel to the roll axis, can be affected, and their malfunctions can cause jamming of the carriage.

In another construction (EP 0 026 903), an axial displacement force of outwardly arranged, parallel piston-cylinder units is transmitted over a main traverse, over opposite, acting in parallel, holding plates, and a piston-cylinder unit for releasing the holding plates, when the roll unit needs to be replaced. Here, the third piston-cylinder unit takes over only the replacement function. Nevertheless, here also no measures are provided for protection of the traverse against hydraulic or electrical malfunctions.

Finally, known is an axially displacing and holding device for displaceably supported intermediate rolls of a cluster mill (DE 31 45 134C2) and which produces high axial forces and which can be rapidly disengaged from journals of the intermediate rolls for replacing the rolls. Here, on each carriage, an axial support block is displaced with parallel mandrels. The coupling means is formed as a chuck for connection with the intermediate roll journal. Here also, a traverse for the piston-cylinder units is needed, but likewise, a danger of jamming of a carriage exists.

An object of the invention is to lock the intermediate rolls and/or working rolls in traverses in such a way and so relocate the engagement point of the displacement force that the traverse cannot be damaged as a result of a hydraulic or electric malfunction.

The set object is achieved according to the invention by providing moving beams, which are arranged on opposite sides of the roll chock and are supported in a rolling mill stand housing post by a respective connecting traverse, with the connecting traverses being pivotally connected to the middle of the main traverse, wherein the piston rods of the piston-cylinder units are pivotally connected to ends of the main traverse, and wherein each piston-cylinder unit is controlled according to path by a displacement sensor.

The main advantage consists in the arrangement of the main traverse and the connecting traverse in such a way that tensioning of the main traverse cannot take place. A further advantage consists in a reliable displacement function. In addition, a simplified assembly and maintenance can be effected. These advantages are further achieved because the displacement system is provided mechanically with all of the degrees of freedom, so that a tensioning of the traverse is not possible.

According to an embodiment of the invention, on a drive side between the moving beams, in the roll chock, a locking block for locking the roll is arranged. The advantage consists in a central arrangement, so that transverse forces cannot be produced in case of a breakdown on a non-uniform loading of one of piston-cylinder drives.

It is further proposed to connect the chock with the locking block by a tightening member.

The holding forces can be favorably applied and transmitted when the connecting traverse is connected with the locking block by an axially acting tightening disc arranged in the interior of the connecting traverse in the middle.

Advantageously, the holding force is produced by operating the tightening disc with a hydraulic tightening drive. Because of its central arrangement, the tightening drive is particularly simple and easy operable.

According to further features of the invention even smallest malfunctions can be dealt with. To this end, the length of the displacement path is calculated as a mean value of two displacement paths determined by two associated with each other displacement sensors.

The piston-cylinder units are controlled in such a way that the calculated mean value of the displacement path, which was determined by the two displacement sensor, is communicated to respective automatic control circuits of the piston-cylinder units.

The drawings show an embodiment of the invention which will be explained in detail below. In the drawings.

Figure 1:
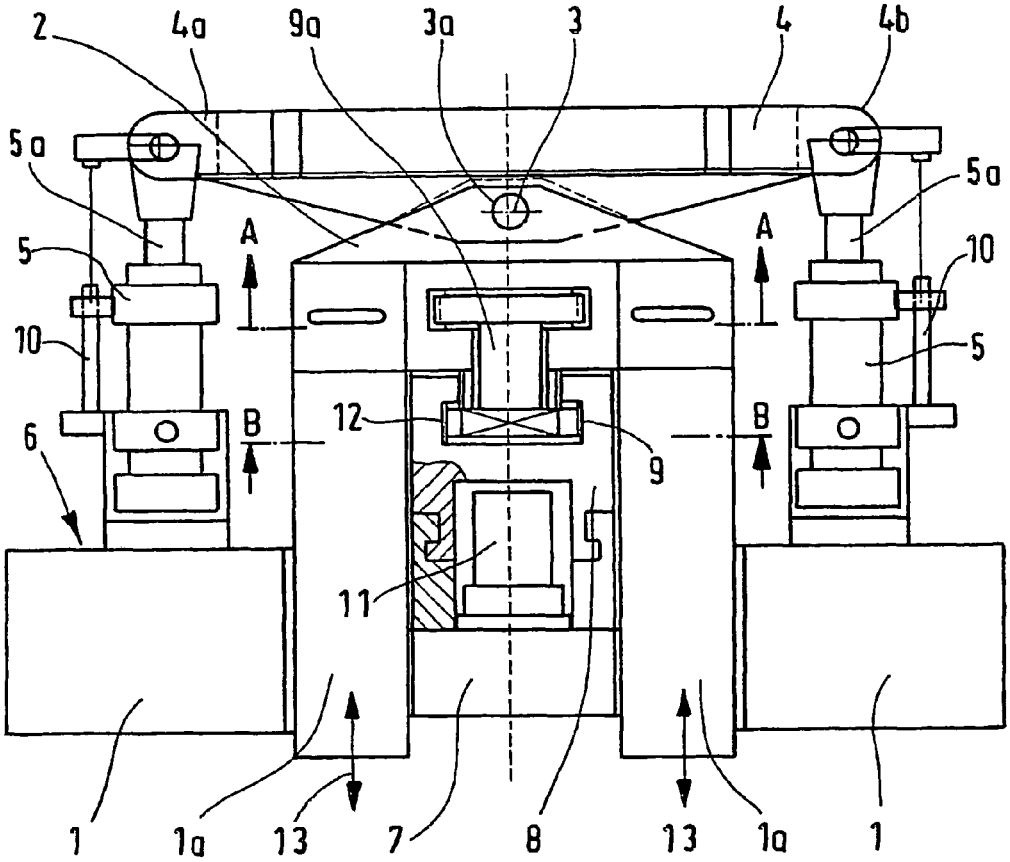
FIG. 1 shows a plan view of a half of a rolling mill stand.

According to FIG. 1, in a mill stand window of a housing post 1 of a rolling mill stand 6, on opposite sides of a chock 7, there are provided moving beams 1*a* which are supported in the housing post 1 by connecting traverses 2, respectively. The connecting traverses 2 are connected to the middle of a main traverse 4 with a connection bolt 3*a* that extends through a ball-and-socket joint 3. This arrangement of the main traverse 4 and of the connecting traverses 2 prevents tensioning that may be caused by a non-uniform operation of piston-cylinder units 5. The piston rods 5*a* of the piston-cylinder units 5 are pivotally attached to opposite ends 4*a*, 4*b* of the main traverse 4. Each piston-cylinder unit 5 is controlled by a displacement sensor 10 immediately from the start of the displacement movement.

On a drive side, there is provided, between the moving beams 1*a* in the roll chock 7, a locking block 8 for locking rolls 11. The locking block 8 is connected with the roll chock 7 by a tightening member 9.

The holding device is so formed that the connecting traverse 2 is secured to the locking block 8 with a tightening disc 12 arranged in the interior of the connecting traverse 2 in the middle and acting axially and/or radially. The tightening disc 12 is operated by a hydraulic tightening drive 9*a*.

The length of the displacement path 13 is calculated as a mean value of two displacement paths 13 determined by two, associated with each other sensors 10. The calculated mean value of the two displacement paths 13, which were determined by the two displacement sensors 10, is communicated to a respective automatic control circuit of the piston-cylinder unit 5.

Figure 2:
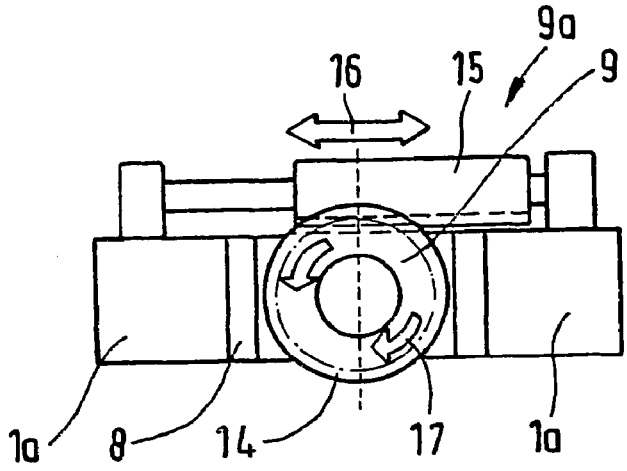
FIG. 2 shows a cross-sectional view along line A—A through the rolling mill stand according to FIG. 1 at the height of a tightening drive.
Figure 3:
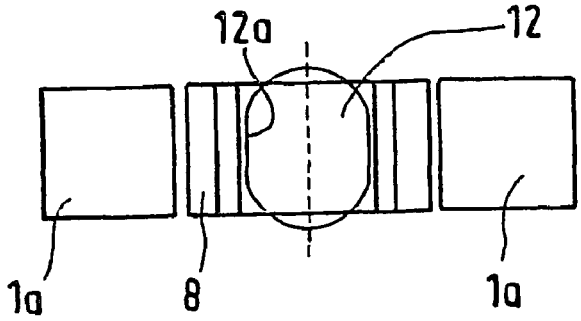
FIG. 3 shows a cross-sectional view along line B—B at the height of a tightening member in an open position.

FIG. 2 shows a plane of the tightening drive 9*a*. A turntable 14 of the tightening drive 9*a*, which rotates in opposite directions, is rotatably supported between the moving beams 1*a*. The rotational movement is produced by a hydraulically, electrically, and/or mechanically operated linear drive mechanism 15, so that a linear movement 16 produces a rotational movement 17 in a respective direction shown with respective arrows. In FIG. 3, the tightening disc 12, which is coaxially arranged beneath the tightening drive 9, is shown in an open position, with its elongate side 12*a* extending vertically. Therefore, the locking block 8 is axially free, and the roll 11, e.g., an intermediate roll can be pulled out axially toward the operational side in order to be replaced.

Figure 4:
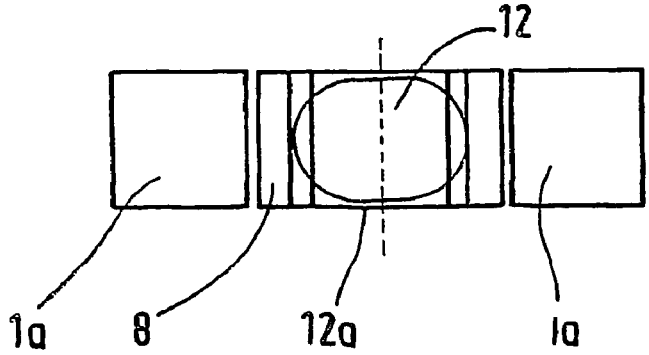
FIG. 4 shows the same cross-sectional view along line B—B in a locking position.

In FIG. 4, the tightening disc 12*a* is displaced by the tightening drive 9*a* in a position in which its elongate side 12*a* extends horizontally, and the locking block 8 cannot be axially displaced anymore, i.e., the moving beam 1*a*, the locking block 8, the connecting traverse 2, together with the main traverse 4, form a rigid assembly.

REFERENCE NUMERALS

1. Rolling mill housing post
1*a*. Moving beam
2. Connecting traverse
3. Ball-and-socket joint
3*a*. Connection belt
4. Main traverse
4*a*. End of a main traverse
4*b*. End of a main traverse
5. Piston-Cylinder Unit for displacement
5*a*. Piston rod
6. Rolling mill stand
7. Roll chock
8. Locking block
9. Tightening member
9.*a* Tightening drive
10. Displacement sensor
11. Roll
12. Tightening disc
12*a* Elongate side
13. Displacement path
14. Turntable
15. Linear drive mechanism
16. Linear movement
17. Rotational movement

The invention claimed is:

1. A cluster mill, in particular a six-high cluster mill, comprising an axial displacing and holding device for displaceably supported intermediate rolls and/or working rolls, wherein chocks are slidably displaced in rolling mill stands in a direction of a roll separating force, and wherein the intermediate rolls and/or working rolls, together with their respective chocks, are displaceable in axial opposite directions by hydraulic piston-cylinder units acting in a direction of roll axes, with both piston rods being pivotally connected by a respective main traverse, characterized in that moving beams (1*a*), which are arranged on opposite sides of the roll chock (7), are supported in a rolling mill stand housing post (1) by a respective connecting traverse (2), that the connecting traverses (2) are pivotally connected to the middle of the main traverse (4), wherein the piston rods (5*a*) of the piston-cylinder units (5) are pivotally connected to ends (4*a*, 4*b*) of the main traverse (4), and wherein each piston-cylinder unit (5) is controlled according to path by a displacement sensor (10).

2. A cluster mill according to claim 1, characterized in that on a drive side, between the moving beams (1*a*), in the roll chock (7), a locking block (8) for locking the roll (11) is arranged.

3. A cluster mill according to claim 2, characterized in that a tightening member (9) connects the roll chock (7) with the locking block (8).

4. A cluster mill according to claim 2, characterized in that the connecting traverse (2) is connected with the locking block (8) by an axially acting, tightening disc (12) arranged in an interior of the connecting traverse (2) in the middle thereof.

5. A cluster mill according to claim 4, characterized in that the tightening disc (12) is operated by a hydraulic tightening device (9*a*).

6. A cluster mill according to claim 1, characterized in that a length of the displacement path (13) is calculated as a mean value of two displacement paths (13) determined by associated displacement sensors (10).

7. A cluster mill according to claim 6, characterized in that the calculated mean value of the displacement paths (13), which was determined by the two displacement sensor (10), is communicated to respective automatic control circuits of the piston-cylinder units (5).

* * * * *